US005615275A

United States Patent [19]

Bertagni

[11] Patent Number: 5,615,275

[45] Date of Patent: Mar. 25, 1997

[54] PLANAR DIAPHRAGM LOUDSPEAKER WITH COUNTERACTIVE WEIGHTS

[75] Inventor: Eduardo J. Bertagni, Tustin, Calif.

[73] Assignee: Sound Advance Systems, Inc., Santa Ana, Calif.

[21] Appl. No.: 426,642

[22] Filed: Apr. 21, 1995

Related U.S. Application Data

[63] Continuation of Ser. No. 78,386, Jun. 17, 1993, abandoned.

[51] Int. Cl.[6] ..... H04R 25/00; H04R 7/00

[52] U.S. Cl. ..... 381/203; 381/202; 181/173

[58] Field of Search ..... 381/205, 188, 381/203, 202; 181/160, 166, 168, 171, 173, 157, 174

[56] References Cited

U.S. PATENT DOCUMENTS 3,722,617 3/1973 Bertagni .

4,003,449 1/1977 Bertagni ..... 181/173

4,013,846 3/1977 Krawczak et al. .

*Primary Examiner*—Sinh Tran

*Attorney, Agent, or Firm*—Pretty, Schroeder, Brueggemann & Clark

[57] ABSTRACT

A planar-type loudspeaker incorporating a substantially planar diaphragm constructed from a pre-expanded cellular plastic material, such as polystyrene, in which one or more balancing weights are embedded in a resilient material within recesses formed in the rear surface of the diaphragm. The resilient material enables the weights a degree of movement relative to the diaphragm, such that the weights can serve a counteractive function to help control the frequency response characteristic of the diaphragm.

20 Claims, 2 Drawing Sheets

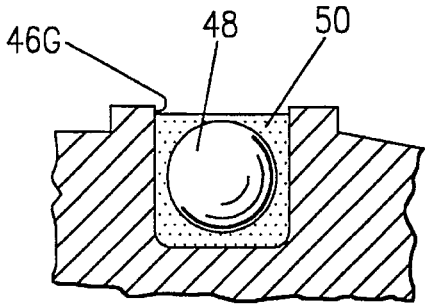
Fig.5
Fig.6A
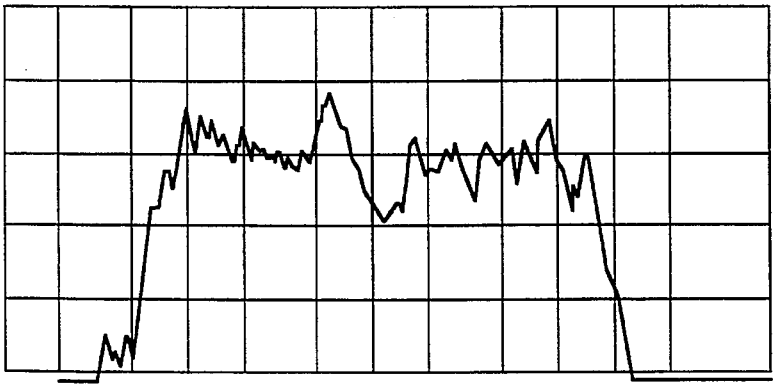
Fig.6B
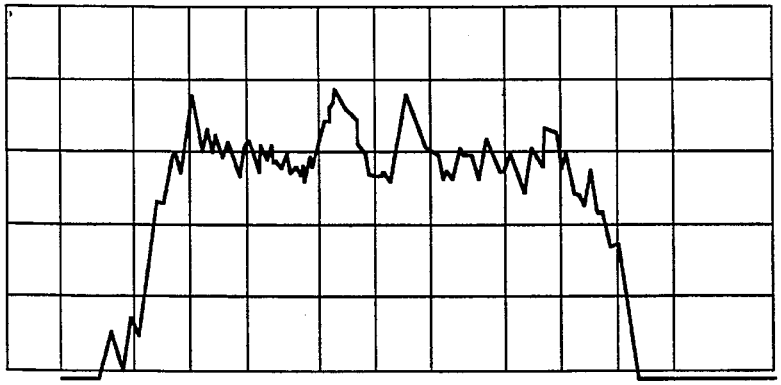
Fig.6C
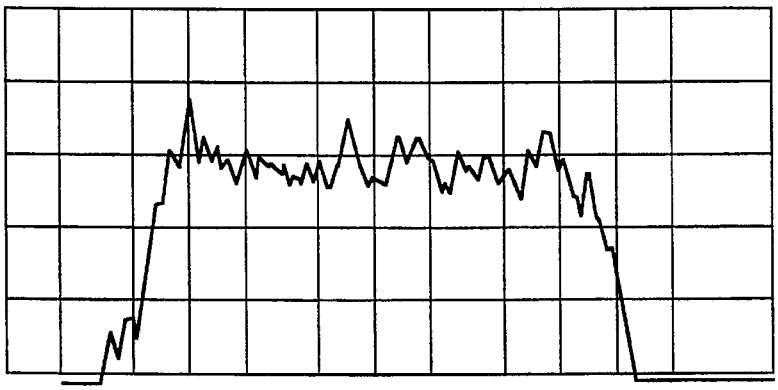

PLANAR DIAPHRAGM LOUDSPEAKER WITH COUNTERACTIVE WEIGHTS

This application is a continuation, of application Ser. No. 08/078,386, filed Jun. 17, 1993, now abandoned.

BACKGROUND OF THE INVENTION

This invention relates generally to planar-type loudspeakers having a substantially flat diaphragm.

In recent years, certain advances in dynamic loudspeaker design have been provided by the advent of planar diaphragm loudspeakers. Such loudspeakers include a relatively stiff and substantially planar (or flat) diaphragm that is mounted in a frame and that is coupled at its rear surface to a speaker voice coil, such that the voice coil acts like a piston, pressing on the rear surface of the diaphragm and causing sufficient vibration of the diaphragm to efficiently produce sound. Examples of such planar diaphragms are shown and described in U.S. Pat. Nos. 4,003,449 and 4,997,058, both issued in the name of Jose J. Bertagni.

Typically, a planar diaphragm is constructed of a pre-expanded cellular plastic material, such as polystyrene or styrofoam. The advantages provided by planar diaphragm loudspeakers over loudspeakers utilizing conventional cone-type diaphragms include greater dispersion of sound and economy of manufacture. Moreover, the front surface of a planar diaphragm can be molded to take on the appearance of a relatively large acoustic tile, permitting unobtrusive installation of the loudspeaker in ceilings of commercial structures formed of like-appearing acoustic tiles. Alternatively, the diaphragm's front surface can be molded smooth and flat for installation as a seamless part of a plasterboard wall or ceiling, as shown and described in co-pending application Ser. No. 07/866,067, entitled Planar-type Loudspeaker With Dual Density Diaphragm, filed Apr. 9, 1992 in the name of Alejandro J. Bertagni et al., and assigned to the same assignee as the present application. A number of such diaphragms also can be joined together in a contiguous and seamless array to create a sound screen upon which video images can be projected, as shown and described in U.S. Pat. No. 5,007,707, issued in the name of Jose J. Bertagni.

Ideally, a loudspeaker exhibits a substantially flat or level response characteristic over the frequency range of sounds that it is designed to reproduce. The frequency response of a planar diaphragm generally is determined by the type and density of its material, and the area, thickness and contour of its sound producing region. Weights also may be inserted in recesses formed in the rear surface of the diaphragm in order to balance it and help shape its frequency response characteristic. These weights are adhered in place by an epoxy cement which drys to a relatively hard state and holds the weights fixedly in place within the recesses.

Balancing weights have been useful in reducing the excursions (i.e., peaks and valleys) in the frequency response of planar diaphragms from a flat or level characteristic. The effectiveness of these weights, however, has proven to be limited. Accordingly, the resulting frequency response characteristic has not always been as flat or level as desired.

Thus, it will be appreciated that there exists a need for improvement in planar diaphragm loudspeakers to provide a better frequency response characteristic. The present invention fulfills this need.

SUMMARY OF THE INVENTION

Briefly, and in general terms, the present invention resides in a planar diaphragm loudspeaker in which one or more weights are embedded in a resilient material within recesses formed in the rear surface of the diaphragm to enable the weights a degree of relative movement as the diaphragm vibrates. In accordance with the invention, the weights will move in various degrees of phase relative to the movement of the diaphragm, depending on the frequency. It has been discovered that by strategic positioning of the weights, the frequency response characteristic of the diaphragm can be improved by neutralizing or countering uncontrolled movement of the diaphragm at certain frequencies, and by enhancing movement of the diaphragm at other frequencies. As a result, the frequency response characteristic of the diaphragm can be rendered more flat or level.

More specifically, and by way of example only, a loudspeaker in accordance with the present invention includes a planar diaphragm and a voice coil assembly, the diaphragm having a front surface for the reproduction of sound and a rear surface to which the voice coil assembly is coupled to cause the diaphragm to vibrate. A plurality of recesses are formed in the rear surface of the diaphragm in an empirically determined pattern. The recesses are sized to receive weights with a clearance fit. Each weight is embedded in a resilient material within its recess to enable the weight a degree of movement relative to the diaphragm.

Preferably, the resilient material is an adhesive that also serves to retain the weights within the recesses. In a presently preferred embodiment, a silicone adhesive is used for this material.

Loudspeakers incorporating the present invention are simple and economical to manufacture, yet can provide an improved frequency response. These features and advantages of the present invention should be apparent from the following description of the preferred embodiment, taken in conjunction with the accompanying drawings, which illustrate, by further way of example, the principles of the invention.

BRIEF DESCRIPTION OF THE DRAWINGS

FIG. 5 is an enlarged, fragmentary cross-sectional view of one of the recesses formed in the rear surface of the diaphragm, showing a weight embedded in a resilient material within the recess; and FIGS. 6A, 6B and 6C are curves illustrating the frequency response characteristics of the diaphragm without weights, with weights embedded in a hard epoxy adhesive, and with weights embedded in a resilient material, respectively.

DESCRIPTION OF THE PREFERRED EMBODIMENTS

Figure 1:
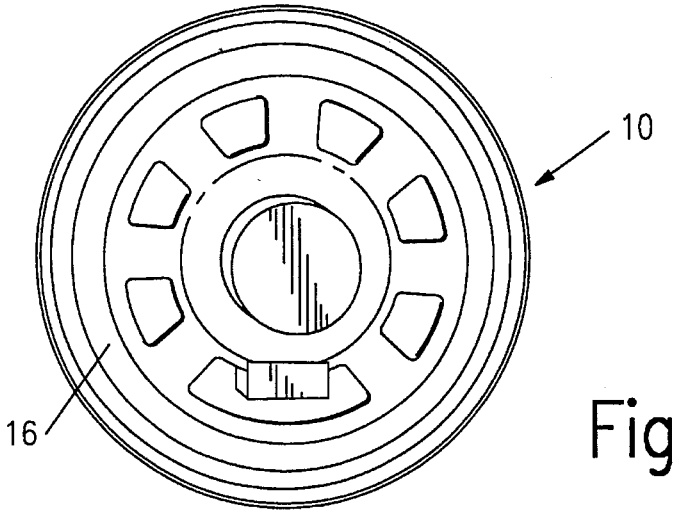
FIG. 1 is a perspective view of one embodiment of a two-piece planar diaphragm loudspeaker incorporating the present invention.
Figure 3:
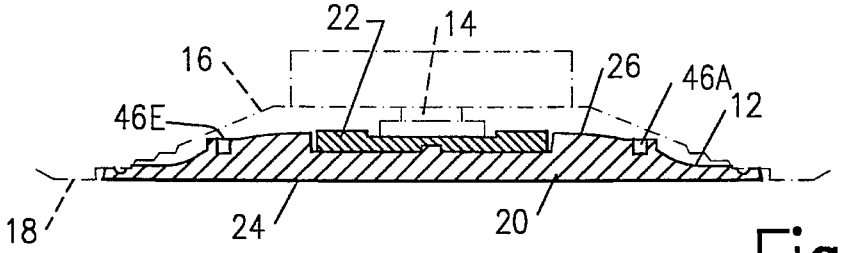
FIG. 3 is a cross-sectional view taken along the line 3—3 through the diaphragm illustrated in FIG. 2.

Referring now to the drawings, and particularly to FIGS. 1 and 3 thereof, there is shown a planar diaphragm loudspeaker, indicated generally by reference numeral 10, including a diaphragm 12 and a voice coil assembly 14 coupled to the diaphragm within a supporting frame structure 16. In the configuration illustrated, the loudspeaker 10 is designed to be received within an opening in a ceiling or wall (not shown), and the supporting frame structure 16 includes a rim 18 (FIG. 3) for surface mounting the front of the loudspeaker. The supporting frame structure 16, including the mounting rim 18, and the voice coil assembly 14 are conventional and thus are indicated only by phantom lines in FIG. 3.

Figure 4:
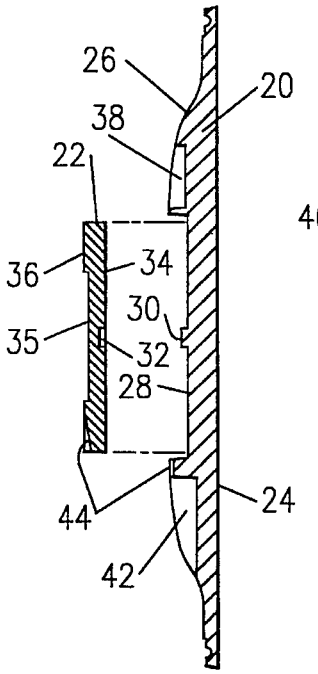
FIG. 4 is a cross-sectional view taken along the line 4—4 through the diaphragm illustrated in FIG. 2, showing the two diaphragm members separated.
Figure 2:
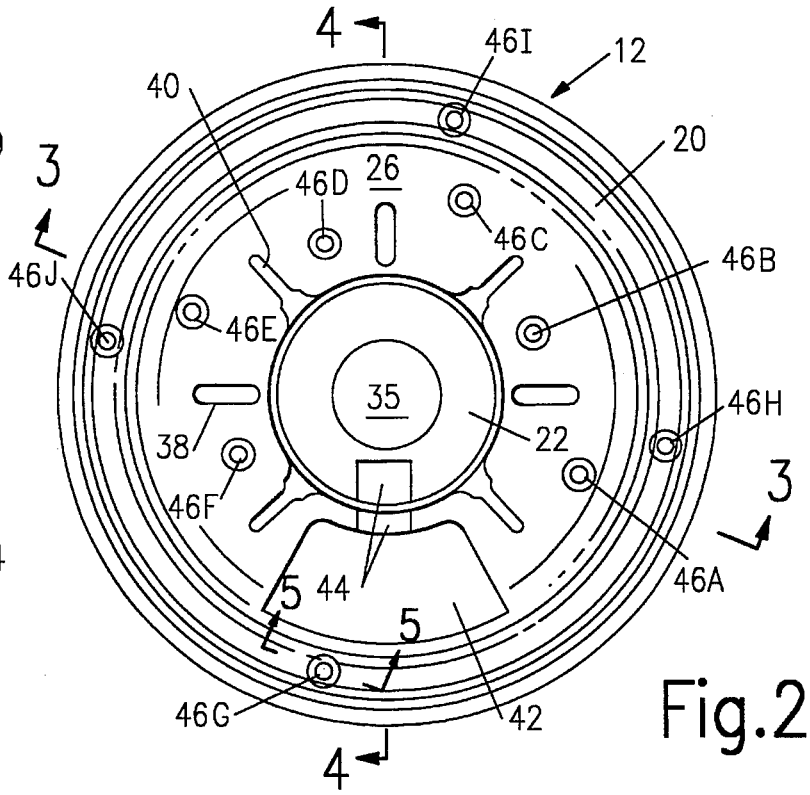
FIG. 2 is a plan view of the rear surface of the diaphragm shown removed from the loudspeaker illustrated in FIG. 1, illustrating a plurality of recesses formed in the rear surface of the diaphragm to receive weights.

As shown in FIGS. 2–4, the planar diaphragm 12 comprises first and second diaphragm members 20 and 22, respectively, both of which are generally flat and have a circular shape. The first diaphragm member 20 has a substantially larger diameter than the second diaphragm member 22 and its face surface 24 is exposed at the front of the loudspeaker 10 for the reproduction of sound. The rear surface 26 of the first diaphragm member 20 has a raised center portion that generally tapers with a gradual curve towards its periphery, where it is attached to the mounting rim 18 by any suitable means such as double-sided tape. In the center of the rear surface 26 of the first diaphragm member 20 there is formed a circular recess 28 (FIG. 4) of sufficient diameter and depth to receive the second diaphragm member 22. At the center of this circular recess 28 there is formed a centering pin 30 which aligns with a centering hole 32 formed in the center of the front surface 34 of the second diaphragm member 22. The second diaphragm member 22 is adhered within the circular recess 28 to the rear surface 26 of the first diaphragm member 20 by epoxy cement. A circular recess 35 is formed in the rear surface 36 of the second diaphragm member 22, in turn, for coupling to the voice coil assembly 14, also by epoxy cement.

To enhance the frequency response of the loudspeaker 10, the first diaphragm member 20 and the second diaphragm member 22 have different densities, as described in copending application Ser. No. 07/866,067, which is incorporated herein by reference. Moreover, it has been found desirable to form a number of radially-extending grooves 38 and recesses 40 in the rear surface 26 of the first diaphragm member 20 (FIG. 2) for improved linearity of vibrational movement of the diaphragm during operation.

As previously mentioned, it has been known to provide holes in the rear surface of a planar diaphragm in which metal weights are held by epoxy cement to correct for imbalance in the diaphragm. For example, as shown in FIGS. 2 and 4, the first and second diaphragm members 20 and 22 exhibit such an imbalance resulting from a wedge-shaped recess 42 formed in the rear surface 26 of the first diaphragm member and a rectangular recess 44 extending on an incline from the wedge-shaped recess 42 into the second diaphragm member. These recesses 42 and 44 provide clearance for a conventional transformer (not shown) that may be mounted within the frame structure 16, so that the diaphragm 12 does not contact the transformer while vibrating. As seen in FIG. 2, a plurality of recesses 46A–46J are formed in the rear surface of the diaphragm to receive balancing weights.

In accordance with the present invention, it has been found that the frequency response characteristic of the diaphragm can be improved by embedding the weights in a resilient material. As shown in FIG. 5, a representative balancing weight 48, in the form of a carbon steel ball or sphere, is received within one of the recesses 46G. The recess 46G is sized, as are the other recesses 46A–46F and 46H–46J, to provide clearance entirely around the weight 48. A silicone adhesive 50 encases the weight so that it is effectively suspended within the recess 46G. Advantageously, the resiliency of the silicone 50 thus not only permits the weight 48 a certain amount of movement relative to the diaphragm 12, but its adhesive qualities serve to hold the weight within the recess 46G. In this example, for an 8-inch diameter diaphragm, the weight 48 is a 0.3 inch diameter sphere weighing approximately 0.075 ounces, and the adhesive is identified as RTV732 Multi-Purpose Adhesive/Sealant from Dow Corning Corporation, Midland, Mich. Other materials can be used instead of silicone, provided they have an acceptable resilience.

FIG. 6A illustrates the frequency response characteristic of the diaphragm 12 without balancing weights, and FIGS. 6B and 6C illustrate the frequency response characteristics of the diaphragm with three weights embedded in a hard epoxy adhesive and silicone adhesive within the recesses 46G, 46H, and 46I (FIG. 2), respectively. In FIG. 6A, the undesirable peak at 600 Hz and 900 Hz and the valley (or hole) between 800 and 1,500 Hz are notable. When the three weights are added and embedded in hard epoxy adhesive (DP100NS Epoxy from 3M Company), the hole (800 to 1,500 Hz) is improved, but the peak at 600 Hz remains and a new peak at 1,500 Hz forms, as seen in FIG. 6B. With the three weights embedded in the silicone at the same locations, the peaks at 600 Hz and 1,500 Hz are diminished, and no additional peaks or valleys develop, as seen in FIG. 6C. It is possible to achieve similar improvements with other diaphragm configurations and placements of weights in resilient material. The number, size and precise positioning of the weights for any particular diaphragm generally need to be determined empirically.

The present invention has been described above in terms of a presently preferred embodiment so that an understanding of the invention can be conveyed. There are, however, many configurations for loudspeakers and diaphragms not specifically described herein for which the present invention is applicable. The present invention should therefore not be seen as limited to the particular embodiments described above. All modifications, variations, or equivalent arrangements that are within the scope of the attached claims should therefore be considered to be within the scope of the invention.

I claim:

1. In a loudspeaker including a planar diaphragm and a voice coil assembly, the diaphragm having a front surface for the reproduction of sound and a rear surface to which the voice coil assembly is coupled to cause the diaphragm to vibrate, the improvement comprising:

a weight;

a boundary wall defining a recess in the rear surface of the diaphragm, the recess sized to receive the weight with a clearance fit; and a resilient material within the recess, separate and distinct from the weight, wherein the weight is embedded in the resilient material, spaced from the boundary wall defining the recess, to enable the weight a degree of movement relative to the diaphragm, such that as the diaphragm vibrates the weight helps to control the movement of the diaphragm at various frequencies.

2. A loudspeaker as set forth in claim 1, wherein the resilient material comprises an adhesive that retains the weight within the recess.

3. A loudspeaker as set forth in claim 1, wherein the resilient material comprises a silicone compound.

4. A loudspeaker as set forth in claim 1, wherein the resilient material comprises a silicone adhesive that retains the weight within the recess.

5. A loudspeaker as set forth in claim 1, wherein the weight moves in various degrees of phase relative to the movement of the diaphragm, depending on the frequency, to render the characteristic frequency response of the diaphragm more flat or level.

6. A loudspeaker as set forth in claim 1, wherein the movement of the weight within the recess in the resilient material counters the vibrations of the diaphragm at certain frequencies and enhances the vibrations of the diaphragm at other frequencies.

7. A loudspeaker as set forth in claim 6, wherein:

the diaphragm exhibits a characteristic frequency response having peaks and valleys with respect to a flat frequency response; and the weight is empirically sized and the recess empirically located so that the weight counters the of the diaphragm at a frequency associated with a peak in the characteristic frequency response of the diaphragm and enhances the of the diaphragm at a frequency associated with a valley in the characteristic frequency response of the diaphragm to flatten the weighted frequency response of the diaphragm.

8. A loudspeaker as set forth in claim 1, wherein the weight is a spherical ball.

9. A loudspeaker as set forth in claim 8, wherein the weight is formed of carbon steel and the resilient material comprises a silicon adhesive.

10. A loudspeaker as set forth in claim 9, wherein said spherical ball has a diameter of about 0.3 inches and a weight of approximately 0.075 ounces.

11. In a loudspeaker including a planar diaphragm and a voice coil assembly, the diaphragm having a front surface for the reproduction of sound and a rear surface to which the voice coil assembly is coupled to cause the diaphragm to vibrate, the improvement comprising:

a plurality of weights;

a plurality of boundary walls, each boundary wall defining a recess in the rear surface of the diaphragm in a prescribed pattern; and a resilient material within each of the plurality of recesses, separate and distinct from the weights, wherein said each recess is sized to receive a weight of said plurality weights with a clearance fit providing space between the weight and the boundary wall of the recess, and further wherein said each weight is embedded in the resilient material within the recess to enable the weight a degree of movement relative to the diaphragm, such that the weights help control the response characteristics of the diaphragm at various frequencies.

12. A loudspeaker as set forth in claim 11, wherein the resilient material comprises an adhesive that retains the weights within the recesses.

13. A loudspeaker as set forth in claim 12, wherein the resilient material comprises a silicone compound.

14. A loudspeaker as set forth in claim 13, wherein the resilient material comprises a silicone adhesive that retains the weights within the recesses.

15. A loudspeaker for the reproduction of sound, comprising:

a planar diaphragm having a front surface for the reproduction of sound and a rear surface;

a voice coil assembly coupled to the rear surface to cause the diaphragm to vibrate and reproduce sound at its front surface, wherein the characteristic frequency response of the diaphragm has peaks and valleys with respect to a flat frequency response;

a weight;

a boundary wall defining a recess in the rear surface of the diaphragm, the recess sized to receive the weight with a clearance fit; and a resilient material within the recess, separate and distinct from the weight, wherein the weight is encased in the resilient material, the resilient material and suspending the weight within the recess, with the weight spaces from the boundary wall defining the recess to permit the weight a certain amount of movement relative to the diaphragm so that the weight counters the vibrations of the diaphragm at certain frequencies and enhances the vibrations of the diaphragm at other frequencies, and wherein the weight is sized and the recess located so that the weight counters the vibrations of the diaphragm at a frequency associated with a peak in the characteristic frequency response of the diaphrams and the weight enhances the vibrations of the diaphram at a frequency associated with a valley in the characteristic frequency response of the diaphram to flatten the weighted frequency response of the diaphram.

16. A loudspeaker as set forth in claim 15, wherein the weight is a spherical steel ball.

17. A loudspeaker as set forth in claim 15, wherein the weight weighs approximately 0.075 ounces and the resilient material comprises a silicone adhesive.

18. A method for reproducing sound, comprising:

providing a planar diaphragm having a front surface for the reproduction of sound and a rear surface;

vibrating the rear surface of the diaphram to cause the front surface of the diaphram to reproduce sound, wherein the characteristic frequency response of the diaphram has peaks and valleys with respect to a flat frequency response;

providing a weight;

providing a boundary wall defining a recess in the rear surface of the diaphragm, the recess sized to receive the weight with a clearance fit;

embedding the weight in a resilient material, separate and distinct from the weight, to hold the weight in the recess, but spaced from the boundary wall defining the recess to permit the weight a certain amount of movement relative to the diaphragm, so that the weight counters the vibrations of the diaphragm at certain frequencies and enhances the vibrations of the diaphram at other frequencies; and sizing and locating the weight, and the recess, so that the weight counters the vibrations of the diaphram at a frequency associated with a peak in the characteristic frequency response of the diaphram and the weight enhances the vibrations of the diaphram at a frequency associated with a valley in the diaphragm's characteristic frequency response of the diaphragm to flatten the weighted frequency response of the diaphragm.

19. A method as set forth in claim 18, wherein the weight is a spherical steel ball.

20. A loudspeaker as set forth in claim 18, wherein the weight weighs approximately 0.075 ounces and the resilient material comprises a silicone adhesive.

* * * * *

UNITED STATES PATENT AND TRADEMARK OFFICE

CERTIFICATE OF CORRECTION

PATENT NO. : 5,615,275

DATED : March 25, 1997

INVENTOR(S) : Eduardo J. Bertagni

It is certified that error appears in the above-indentified patent and that said Letters Patent is hereby corrected as shown below:

Column 5, Claim 7, line 16, insert between the words "the of" -- vibrations --.
Column 5, Claim 7, line 19, insert between the words "the of" -- vibrations --.
Column 5, Claim 11, line 43, after "plurality" insert -- of --.
Column 6, Claim 15, line 8, after "material" insert -- holding --.
Column 6, Claim 15, line 9, delete "spaces" and substitute therefor -- spaced --.
Column 6, Claim 15, line 20, delete "diaphrams and substitute therefor -- diaphragm --.
Column 6, Claim 15, lines 21-25 delete "diaphram" and substitute therefor -- diaphragm --.
Column 6, Claim 18, lines 35, 36, 38, 51-52, 54, 56, 57, delete "diaphram" and substitute therefor -- diaphragm --.

Signed and Sealed this

Fifteenth Day of July, 1997

*Attest:*

*Attesting Officer*

BRUCE LEHMAN

*Commissioner of Patents and Trademarks*